US009267774B2

(12) United States Patent
Amon et al.

(10) Patent No.: US 9,267,774 B2
(45) Date of Patent: Feb. 23, 2016

(54) MISSILE WARHEAD

(71) Applicant: ISRAEL MILITARY INDUSTRIES LTD., Ramat HaSharon (IL)

(72) Inventors: Jacob Amon, Natanya (IL); Anna Schwartz, Raanana (IL); Yaron Brandeis, Kfar Sava (IL)

(73) Assignee: ISRAEL MILITARY INDUSTRIES LTD., Ramat Hasharon (IL)

( * ) Notice: Subject to any disclaimer, the term of this patent is extended or adjusted under 35 U.S.C. 154(b) by 0 days.

(21) Appl. No.: 14/387,865

(22) PCT Filed: Mar. 24, 2013

(86) PCT No.: PCT/IL2013/000035
§ 371 (c)(1),
(2) Date: Sep. 25, 2014

(87) PCT Pub. No.: WO2013/150511
PCT Pub. Date: Oct. 10, 2013

(65) Prior Publication Data

US 2015/0059610 A1 Mar. 5, 2015

(30) Foreign Application Priority Data

Apr. 3, 2012 (IL) ..... 219010

(51) Int. Cl.
*F42B 12/08* (2006.01)
*F42B 12/04* (2006.01)
(Continued)

(52) U.S. Cl.
CPC ..... *F42B 12/08* (2013.01); *F42B 12/04* (2013.01); *F42B 12/06* (2013.01); *F42B 12/20* (2013.01)

(58) Field of Classification Search
CPC ..... F42B 12/02; F42B 12/04; F42B 12/06; F42B 12/08; F42B 12/20; F42B 12/201; F42B 12/204; F42B 10/46
USPC ..... 102/473, 517, 518, 519
See application file for complete search history.

(56) References Cited

U.S. PATENT DOCUMENTS 33,863 A 12/1861 Woodbury
2,258,281 A 10/1941 Dunajeff
(Continued)

FOREIGN PATENT DOCUMENTS

CA 2279325 A1 7/1999
EP 0161367 A2 11/1985
(Continued)

OTHER PUBLICATIONS

MBDA Validates CMP 1000 Penetrator Warhead, Press Release, Jan. 30, 2009, http://www.mbda-systems.com/mbda/site/ref/scripts/newsFO_complet.php?lang=EN&news_id=269.
(Continued)

*Primary Examiner* — James S Bergin
(74) *Attorney, Agent, or Firm* — Harness, Dickey & Pierce, P.L.C.

(57) ABSTRACT

A warhead nose comprises a conical/ogive body having an outer surface with a top circumference and base circumference, and ribs extending along the outer surface of the conical/ogive body tapering so that the circumference around the ribs is smaller than or equal to the circumference of the base, the warhead nose dimensions are determined by the following relations:

$$E \le D,\quad \frac{1}{5}D \le F \le 2D,\quad G \le \frac{1}{5}D,\quad \frac{1}{20}D \le H \le \frac{1}{2}D,\quad I \le \frac{2}{5}D$$

where,

D is maximum nose diameter; E is external diameter of the ribs; F is length of the ribs along the nose; G is minimal width of the ribs; H is height of the rib protrusion; and I is the minimal width of the rib at the adjoining point with the nose.

8 Claims, 6 Drawing Sheets

(51) Int. Cl.
*F42B 12/20* (2006.01)
*F42B 12/06* (2006.01)

(56) References Cited

U.S. PATENT DOCUMENTS

| | | | | | |
|---|---|---|---|---|---|
| 2,356,227 | A | * | 8/1944 | Diehl | F42B 10/22 102/519 |
| 3,002,453 | A | * | 10/1961 | Fedor | F42B 10/46 102/382 |
| 3,200,751 | A | * | 8/1965 | Vitt | F42B 7/10 102/519 |
| 3,572,250 | A | | 3/1971 | Kriesel et al. | |
| 3,992,998 | A | | 11/1976 | Cordle et al. | |
| 4,301,733 | A | * | 11/1981 | Arciniega Blanco | F42B 7/10 102/448 |
| 4,305,333 | A | | 12/1981 | Altenau et al. | |
| 4,421,032 | A | | 12/1983 | Rudolf et al. | |
| 4,633,782 | A | | 1/1987 | Berube et al. | |
| 4,765,245 | A | | 8/1988 | Berube et al. | |
| 5,116,224 | A | | 5/1992 | Kelsey, Jr. | |
| 5,133,261 | A | | 7/1992 | Kelsey, Jr. | |
| 5,509,357 | A | | 4/1996 | Lawther | |
| 5,939,662 | A | | 8/1999 | Bootes et al. | |
| 6,012,393 | A | | 1/2000 | Tal | |
| 6,135,028 | A | | 10/2000 | Kuhns et al. | |
| 6,283,036 | B1 | | 9/2001 | Munsinger | |
| 6,382,105 | B1 | | 5/2002 | Jones | |
| H2025 | H | | 6/2002 | Munsinger | |
| 6,453,790 | B1 | | 9/2002 | Cesulka et al. | |
| 6,494,140 | B1 | | 12/2002 | Webster | |
| 6,581,522 | B1 | | 6/2003 | Julien et al. | |
| 6,601,517 | B1 | | 8/2003 | Guirguis | |
| 2005/0109233 | A1 | | 5/2005 | Eches et al. | |
| 2010/0263566 | A1 | | 10/2010 | Ruhlman et al. | |

FOREIGN PATENT DOCUMENTS

| | | | | | |
|---|---|---|---|---|---|
| EP | 0760458 | A1 | | 3/1997 | |
| EP | 0845098 | A2 | | 6/1998 | |
| FR | 427713 | A | | 8/1911 | |
| FR | 2711786 | A1 | | 5/1995 | |
| GB | 538276 | A | * | 7/1941 | F42B 12/08 |
| KR | 20010035741 | A | | 5/2001 | |
| TW | 436607 | B | | 5/2001 | |
| WO | WO-9707379 | A2 | | 2/1997 | |
| WO | WO-9935461 | A2 | | 7/1999 | |
| WO | WO-2008118185 | A2 | | 10/2008 | |
| WO | WO-2008118235 | A2 | | 10/2008 | |
| WO | WO-2009045619 | A1 | | 4/2009 | |
| WO | WO-2009082518 | A2 | | 7/2009 | |

OTHER PUBLICATIONS

Extended European Search Report mailed Nov. 20, 2015 regarding European Application No. 13772457.1.

* cited by examiner

MISSILE WARHEAD

CROSS REFERENCE TO RELATED APPLICATIONS

This application is a 371 U.S. National Stage of International Application No. PCT /IL2013/000035, filed Mar. 24, 2013, which claims priority to Israeli Patent Application No. 219010, filed Apr. 3, 2012. The disclosures of the above applications are incorporated herein by reference.

FIELD OF THE INVENTION

The present invention relates to missile warheads especially unguided warheads designed to penetrate hard targets and in particular multiple wall targets.

BACKGROUND OF THE INVENTION

Warheads are often required to penetrate hard concrete or steel targets of either one or multiple layers (walls) and to explode afterwards inside a target cavity. Such warheads have an ogive or a conical nose that assists the penetration by reducing the resistance forces.

This type of warhead is typically made of three sections: (1) a front section, or nose, which is usually in the shape of an ogive or cone; (2) the main section which includes the explosive charge and is usually cylindrical; and (3) the aft section which seals the explosive charge within the casing and holds a penetration fuse for explosive charge initiation.

The warhead which is typically a hollow cylindrically shaped casing, made of high strength steel. Inside the hollow casing lies the explosive charge, and in the rear end of the warhead the penetration fuse is installed. This fuse is designed to initiate the explosive charge at the proper moment, typically, at some predetermined time after the warhead encounters the target.

In penetration warheads, special care is given to the design of the forward penetration nose. The penetration nose must withstand considerable loads, and also, guides the warhead's path through the target (being the first part of the warhead to come in contact with the target), with minimal drag forces. The most widespread approach for penetration nose design is to use a conical or an ogive nose.

When the warhead hits the target at an oblique impact angles, and at the beginning of penetration, asymmetrical forces develop on the conical or ogive nose. Such forces create a rotation moment (torque) around the center of mass of the warhead and cause the warhead to move in a bent line instead of a straight line, or to ricochet, if the warhead hits at shallower impact angles.

This effect is called the J Effect which causes some or all of the following problems: (a) the warhead rotates during target penetration, generating considerable loads on the warhead that may lead to the structural failure of the warhead, (b) the warhead ricochets off the target when the strike angles are shallow, (c) the warhead potential penetration depth of a target is decreased due to bent penetration line, and (d) lateral accelerations acting on the fuse located in the rear part of the warhead increase; such accelerations may cause failure of the fuse during penetration.

The customary design approach to these problems is strengthening the warhead structure by increasing the thickness of the metal and/or changing the kind of metal from which the warhead is made, and strengthening and hardening the warhead fuse to withstand increased side accelerations. This approach has several limitations including an increase in the weight of the weapon system, which is undesirable, reduction of the internal volume for the explosive charge in the warhead and a more complicate design of the penetration fuse. As a result, the cost of the warhead-fuse system increases and its effectiveness decreases.

Another approach is to use a warhead with a blunt nose. This kind of nose reduces the J Effect by creating an opposing force at the beginning of the penetration which balances the moment (torque), but creates much bigger drag forces during the penetration. As a result of the bigger drag forces, some or all of the following problems may develop:

- Reduced penetration capability, especially in perpendicular penetration angles because of the configuration of the nose which significantly increase the drag forces on it.
- Increase of the accelerations along the axis of the warhead, due to the increased resistance or drag forces, which also negatively affect the warhead and the fuse.

Thus, warheads of this kind are limited to strikes at relatively shallow angles and into relatively thin targets only.

In view of the above, an aim of the present invention is to provide an improved warhead that overcomes the drawbacks of the above warheads, i.e., a warhead with a nose having a shape which would reduce the J Effect in a situation of a strike at oblique angles, increase the penetration capability and reduce the loads on the warhead and the fuse, without significant increase of penetration drag.

Another aim of the present invention is to provide a missile warhead having high durability while penetrating multi-layered structural targets, without a significant increase in weight.

Yet, another aim of the present invention is to provide a warhead nose that prevents the warhead from ricocheting off structural targets and assists in target penetration, when shallow approach angles and high angles of attack are reached.

SUMMARY OF THE INVENTION

The present invention is to a penetration warhead having a conical nose and structural ribs along the circumference of the nose. The special penetration cone design gives the warhead the following characteristics:

1. High durability due to reduced stress while penetrating several/layered structural targets, without a significant increase in weight.
2. Correction of the penetration path, minimizing the "J effect", while penetrating several/layered structural targets which increases the potential penetration depth.
3. Minimizing ricochet of the warhead off structural targets and assists in target penetration, when shallow approach angles and high angles of attack are reached.
4. Decreasing the accelerations acting on the rear part of the warhead, thus decreasing the loads on the penetration fuse (located in the rear of the warhead).

Main parts of the penetration nose:

Structural ribs—these ribs may vary in size and even protrude out of the maximal outline of the warhead. The thickness and height of the ribs changes along the length of the warhead nose.

Penetration boss—a boss protruding from the tip of the penetration nose. This boss may be tapered. The boss is not an essential part of the penetration nose for some applications.

The ribs improve the capability of the warhead in the following aspects:

- The structure of the ribs enables the target material to break and pass between them. As a result, the resistance force (drag resistance of the penetration) is reduced substantially, and the penetration capability of the warhead is comparable and almost the same as the penetration capability of a conical warhead without ribs.

The ribs allow the warhead to penetrate into the target at a wide range of oblique strike angles, including relatively shallow strike angles, without bouncing off the surface of the target, and may even split the surface of the target in case of relatively thin targets. During the beginning of the penetration, the ribs in contact with the target develop a resisting force, which balances the disruptive torque and keeps the warhead from bouncing off the surface of the target.

Because of the same mechanism the ribs reduce the movement curvature, e.g., the J Effect, and so allow the warhead to penetrate thicker targets and/or a number of walls in a substantially straight movement in case of non-perpendicular strikes of wall targets. The reduced movement curvature decreases the side forces and torques on the warhead, and thus allows a greater chance of survival and greater reliability of the warhead and the fuse during and after target penetration.

In contrast, warheads having a conical or an ogive nose, rotate after penetrating in oblique angles, reducing the potential penetration capability to hardened targets. In the case of multiple wall penetration, warheads with an ogive or conical nose rotate significantly after the first or second wall penetration, and thus, do not penetrate through the remaining walls.

Thus, in accordance with the present invention, a warhead nose is provided comprising:

a conical/ogive body having an outer surface with a top circumference and base circumference, and ribs extending along the outer surface of the conical/ogive body tapering so that the circumference around the ribs is smaller than or equal to the circumference of the base.

The warhead nose dimensions are determined by the following relations:

$$E \le D$$

$$\frac{1}{5}D \le F \le 2D$$

$$G \le \frac{1}{5}D$$

$$\frac{1}{20}D \le H \le \frac{1}{2}D$$

$$I \le \frac{2}{5}D$$

where,

D is maximum nose diameter;

E is external diameter of the ribs;

F is length of the ribs along the nose;

G is minimal width of the ribs

H is height of the rib protrusion; and

I is the minimal width of the rib at the adjoining point with the nose.

Furthermore a warhead nose is provided, comprising:

a body with a cylindrical section and a conical/ogive section, an outer surface with a top circumference and base circumference, and ribs partially extending from the outer surface of the cylindrical section and partially from the conical section, wherein the circumference around the ribs is larger than the base circumference and the top circumference.

The warhead nose dimensions are determined by the following relations:

$$D \le E$$

$$\frac{1}{5}D \le F \le 2D$$

$$G \le \frac{1}{5}D$$

$$\frac{1}{20}D \le H \le \frac{1}{2}D$$

$$I \le \frac{2}{5}D$$

where,

D is maximum nose diameter;

E is external diameter of the ribs;

F is length of the ribs along the nose;

G is minimal width of the ribs

H is height of the rib protrusion; and

I is the minimal width of the rib at the adjoining point with the nose.

The ribs may be equidistantly spaced apart, and the nose may have a flat or concave tip.

The warhead nose further comprises a cylindrical and/or tapered boss the dimensions of which are determined by the following relations:

$$A \le \frac{1}{2}D$$

$$B \le \frac{1}{2}D$$

$$C \le \frac{1}{2}D$$

where,

D is maximum nose diameter;

A is boss tip diameter;

B is boss base diameter;

C is boss height;

the boss is either cylindrical and/or tapered.

Furthermore, a warhead is provided comprising:

a nose as described above;

a main section which includes an explosive charge; and an aft section which holds a penetration or initiation fuse.

DETAILED DESCRIPTION OF THE INVENTION

Figure 1B:
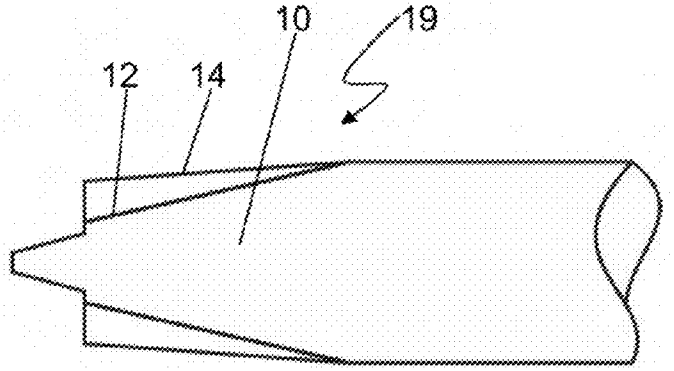
FIG. 1B is a cross sectional side-view of a warhead having the warhead nose of FIG. 1A.
Figure 1A:
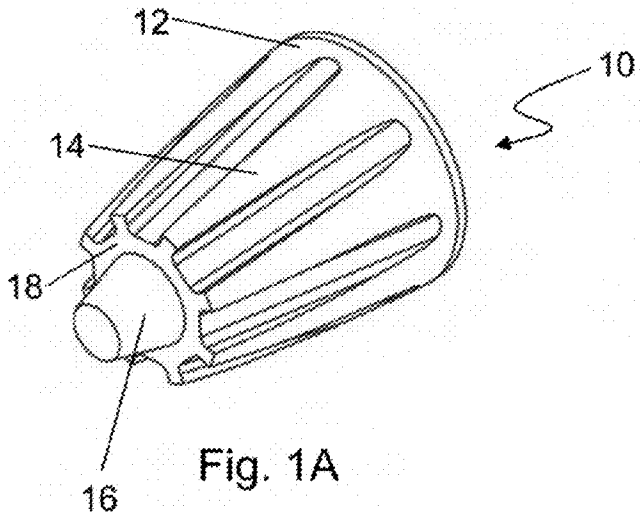
FIG. 1A is a perspective view of a warhead nose in accordance with one embodiment of the present invention.

FIG. 1A is a perspective view of a warhead nose 10 in accordance with one embodiment of the present invention. Warhead nose 10 has a conical body 12, tapered ribs 14 along the outer surface of the conical body 12, and tapered boss 16 protruding from the tip 18 of the nose 10.

FIG. 1B is a cross sectional side-view of a warhead 19 having the warhead nose 10 of FIG. 1A. As seen in FIG. 1B, the addition of ribs 14 does not alter the conical shape of the nose 10.

Figure 1C:
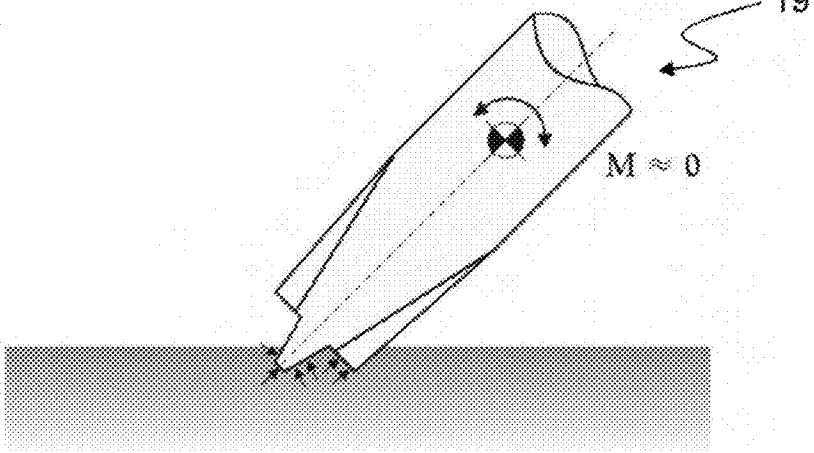
FIG. 1C illustrates the warhead of FIG. 1B at an initial stage of penetration.

FIG. 1C illustrates warhead 19 at an initial stage of penetration. The conical nose 10 and the ribs 14 minimize the rotation moment around the center of mass of the warhead to about zero and thus eliminate the J Effect, i.e., by creating a torque opposing the torque created by the J Effect, and thus causing the warhead to move in almost a straight line.

Figure 2B:
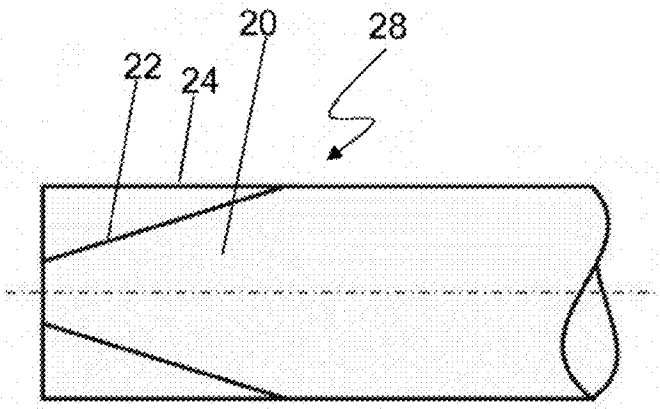
FIG. 2B is a cross sectional side-view of a warhead having the warhead nose of FIG. 2A.
Figure 2A:
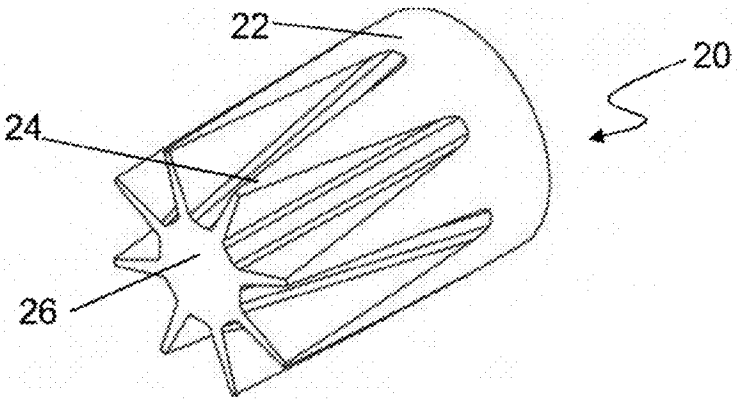
FIG. 2A is a perspective view of a warhead nose in accordance with a second embodiment of the present invention.

FIG. 2A is a perspective view of a warhead nose 20 in accordance with a second embodiment of the present invention. Warhead nose 20 has a relatively short conical body 22, relatively thin ribs 24 along the outer surface of the conical body 22, and a flat tip 26. Ribs 24 are relatively thin to allow penetration into and splitting of the target material without bouncing from the target surface.

As seen in FIG. 2A, nose 20 has a conical body 22, however, the structural profile of the nose 20 together with the ribs 24 is not of a cone, but of a non-solid cylinder which results from the shape and width of the ribs 24.

FIG. 2B is a cross sectional side-view of a warhead 28 having the warhead nose 20 of FIG. 2A.

As can be seen in the figure, unlike the tapered cross section of nose 10, nose 20 has a rectangular cross section.

Figure 2C:
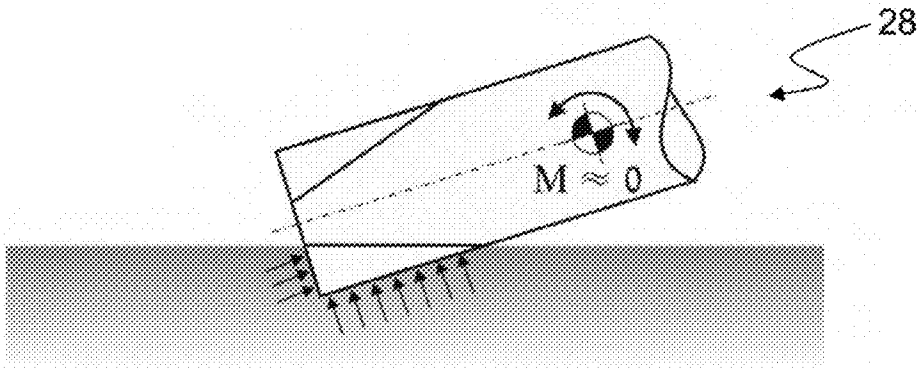
FIG. 2C illustrates the warhead of FIG. 2B at an initial stage of penetration at a relatively low strike angle of between 0° to 45° relative to the plane of the target.

FIG. 2C illustrates the warhead of FIG. 2B at an initial stage of penetration at a relatively low strike angle of between 0° to 45° relative to the plane of the target. In this case, the overall non-solid cylindrical profile of the nose 20 minimizes the rotation moment around the center of mass of the warhead to about zero and thus avoids the J Effect. More specifically, the overall non-solid cylindrical profile of the nose 20 creates a torque opposing the torque created by the J Effect, and thus, causes the warhead to move in an almost straight line, and thus, to penetrate and split the target without bouncing off the target surface.

Figure 3:
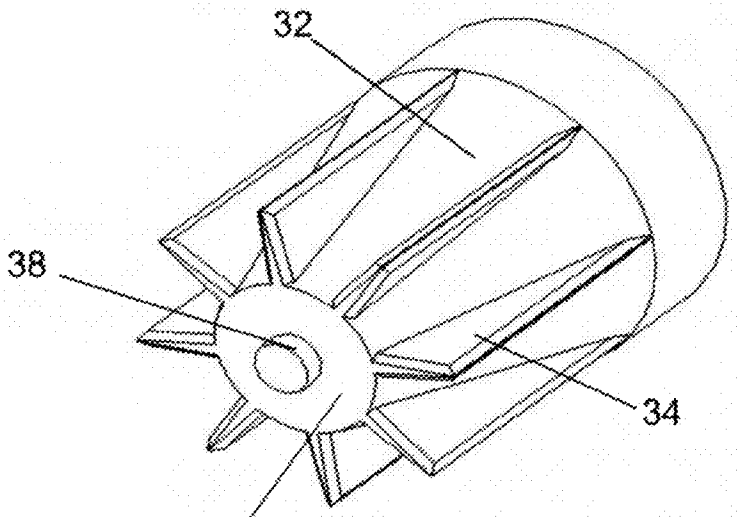
FIG. 3 is a perspective view of a warhead nose in accordance with a third embodiment of the present invention.

FIG. 3 is a perspective view of a warhead nose 30 in accordance with a third embodiment of the present invention. Warhead nose 30 has a conical body 32, tapered ribs 34 along the outer surface of the body 32, and a boss 38 protruding from the flat tip 36 of conical body 32. As in the second embodiment, warhead nose 30 has a non-solid cylindrical shape created by the addition of ribs 34, the shape and width of which complete the conical shape of the body 32 to form the non-solid cylindrical warhead nose 30.

Figure 4:
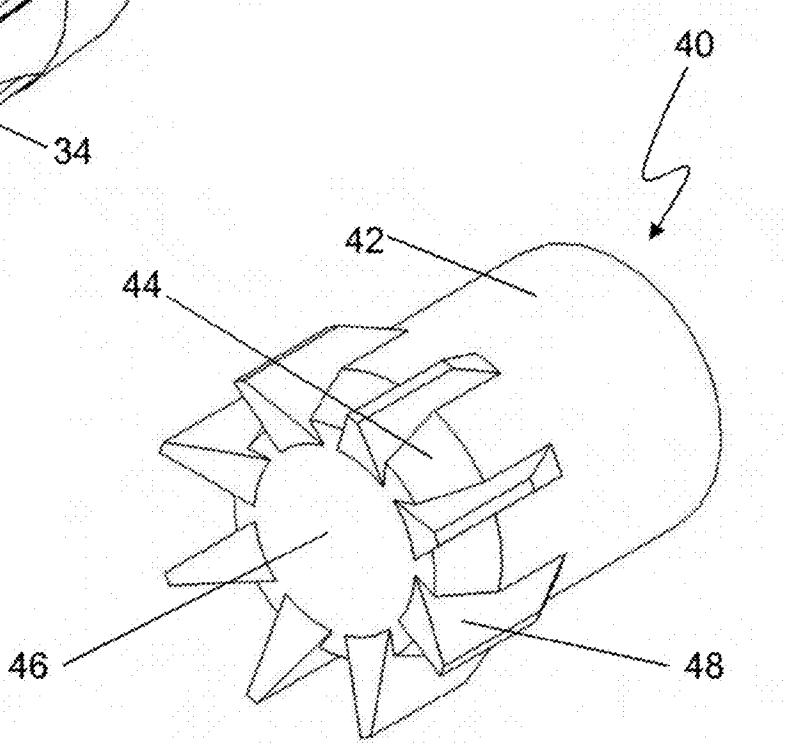
FIG. 4 is a perspective view of a warhead nose in accordance with a forth embodiment of the present invention.

FIG. 4 is a perspective view of a warhead nose 40 in accordance with a fourth embodiment of the present invention. The body of warhead nose 40 includes a relatively long cylindrical section 42 and a relatively short conical section 44 with flat tip 46. Warhead nose 40 contains ribs 48 partially extending from the outer surface of the cylindrical section 42 and partially from the conical section 44. The outer circumference of the nonsolid cylinder created by the ribs is wider than the circumference of the cylindrical body 42 of the nose 40. In this case, the protruding ribs create a non-solid cylindrical shape the diameter of which is greater than the actual diameter of the cylindrical section of the warhead. This design keeps the warhead from bouncing off the target surface when the warhead is installed in the missile, in a sub-caliber configuration (the warhead is an internal part of the missile), when relatively shallow strike angles (0 to 45) are reached. The ribs are first to hit the target and penetrate it, creating a force that prevents the warhead from ricocheting off the target.

The optimized number of the ribs, their shape and dimensions are determined by simulating the penetration of warheads into desired targets. For example the relation between the front rib outer width (G) and the front rib root (I), can be optimized in order to increase or decrease the moment produced by the rib with the same drag. Another example—simulations have shown that a relatively long conical nose with structural ribs each having a relatively small circumference in comparison to the circumference of the warhead may best suit penetrations into relatively thick targets at a strike angle of between 45° to 90° relative to the target plane. In this case, the penetration depth (or exit velocity) into a relatively thick wall target at a strike angle of 90° relative to the target plane, will be equal to the depth reached by a warhead having the same nose but without the structural ribs. However, in case of oblique strike angles, the penetration depth of a warhead with structural ribs may be significantly better.

Figure 5B:
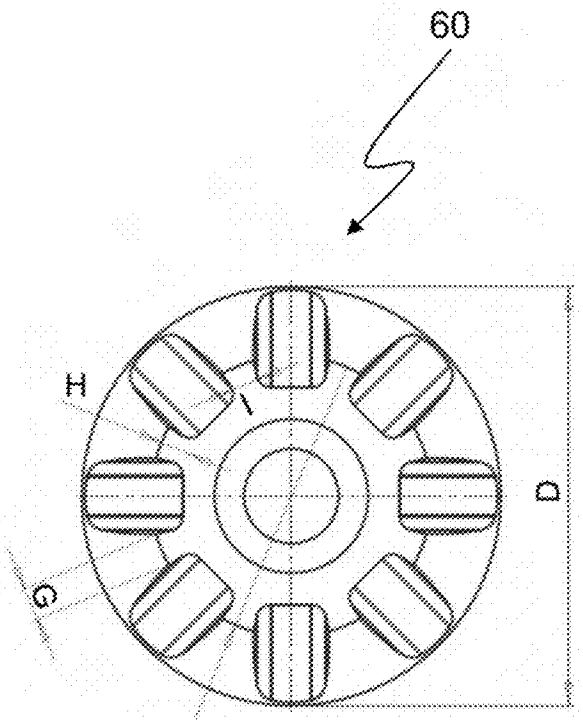
FIGS. 5A and 5B are side and top views of the warhead nose shown in FIG. 1.
Figure 5A:
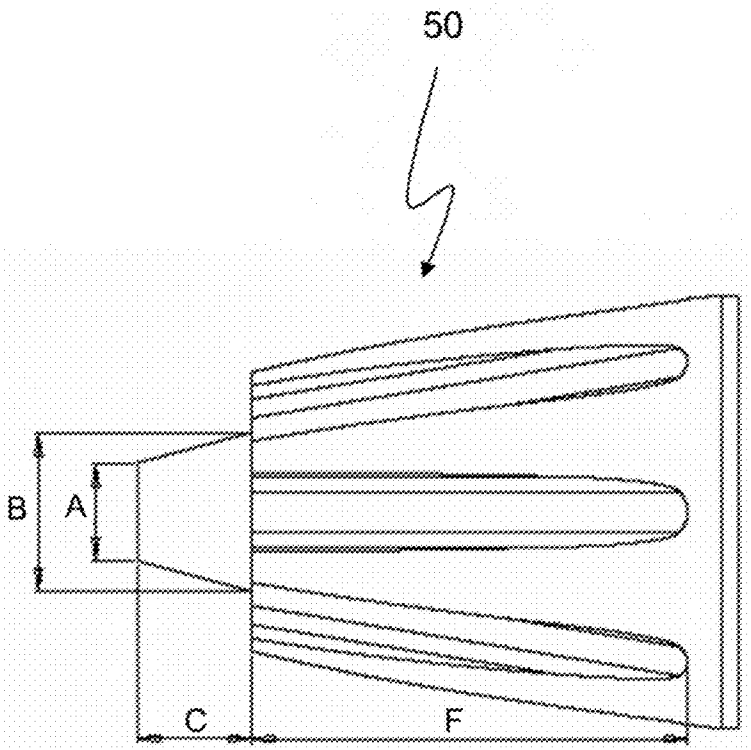

FIGS. 5A and 5B are side and top views of warhead nose 10 shown in FIG. 1. The penetration of a warhead into desired targets is simulated based on the following equations for optimizing the parts marked by variables A-H in FIGS. 5A and 5B, i.e., for designing an optimized warhead that may involve fairly low deflection, i.e., a relatively low J Effect, while penetrating through target(s).

$$A \le \frac{1}{2}D$$

$$B \le \frac{1}{2}D$$

$$C \le \frac{1}{2}D$$

$$E \le D$$

$$\frac{1}{5}D \le F \le 2D$$

$$G \le \frac{1}{5}D$$

$$\frac{1}{20}D \le H \le \frac{1}{2}D$$

$$I \le \frac{2}{5}D$$

Where D is maximum nose diameter;
A is boss tip diameter;
B is boss base diameter;
C is boss height;
E is external diameter of the ribs;
F is length of the ribs along the nose;
G is minimal width of the ribs H is height of the rib protrusion; and I is the minimal width of the rib at the adjoining point with the nose.

Tests

Tests consist of firing a warhead at the intended targets while recording the warhead's progression (speed and attitude) via high-speed cameras. Tests were conducted at various speeds and impact angles.

Figure 6:
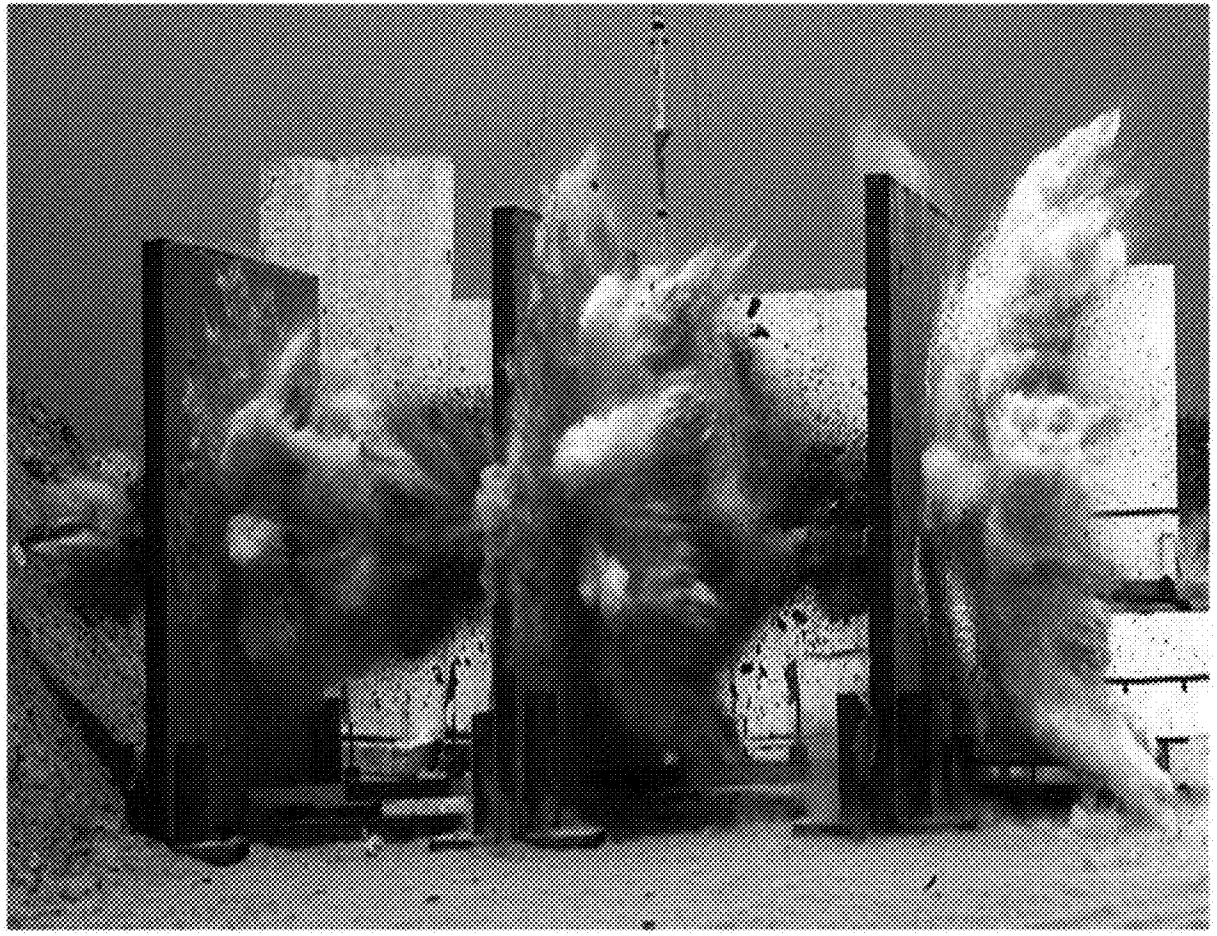
FIG. 6 shows a straight, deflection free, penetration of a warhead of the present invention through 3 concrete walls at a relatively high impact angle of 80° (relative to the wall plane)

FIG. 6 shows a straight, deflection free, penetration of a warhead designed in accordance with the present invention through three concrete walls at a relatively high impact angle. In this test, the impact velocity was 375 m/s and the impact angle, i.e., the angle between the warhead's velocity vector to the target surface, was 80° (relative to the wall plane).

Figure 7:
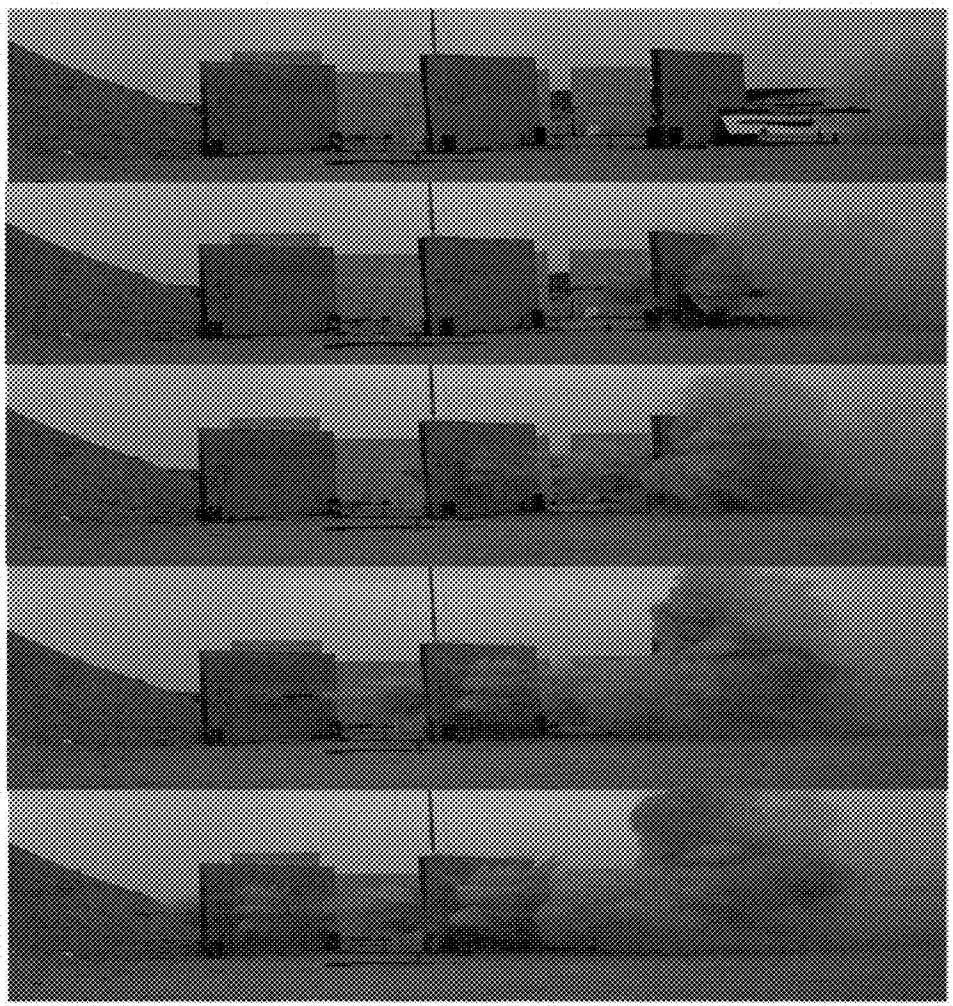
FIG. 7 shows a straight, deflection free, penetration of a warhead of the present invention through 3 concrete walls at an impact angle of 50° (relative to the wall plane).

FIG. 7 shows a straight, deflection free, penetration of the warhead of the present invention through 3 concrete walls at an impact velocity of 310 m/s and at an impact angle of 50° (relative to the wall plane). Again the warhead does not show any deflection, and penetrates the targets in a straight line. In contrast, an impact angle of 50° or lower will cause ordinary warheads to turn around and not penetrate through all layers of the target. The smaller the angle between the velocity vector of the warhead and the target plane, the less likely an ordinary warhead can penetrate through all layers of the target, and the more likely it is to ricochet or exhibit the J-effect.

The invention claimed is:

1. A warhead nose comprising:

a flat or concave tip circumferential surface from which extends a conical/ogive body having an outer surface and a base circumference, and ribs extending from the circumference of the flat or concave tip along the outer surface of the conical/ogive body tapering downward towards the base, wherein the circumference around the ribs is larger than the circumference of the flat or concave tip and smaller than or equal to the circumference of the base, the warhead nose dimensions are determined by the following relations:

$$E \le D$$

$$\frac{1}{5}D \le F \le 2D$$

$$G \le \frac{1}{5}D$$

$$\frac{1}{20}D \le H \le \frac{1}{2}D$$

$$I \le \frac{2}{5}D$$

where,

D is maximum nose diameter;

E is external diameter of the ribs;

F is length of the ribs along the nose;

G is minimal width of the ribs;

H is height of the rib protrusion; and

I is the minimal width of the rib at the adjoining point with the nose.

2. A warhead nose in accordance with claim 1, wherein the ribs are equidistantly spaced apart.

3. A warhead in accordance with claim 1, further comprising a boss extending from the flat or concave tip, the dimensions of which are determined by the following relations:

$$A \le \frac{1}{2}D$$

$$B \le \frac{1}{2}D$$

$$C \le \frac{1}{2}D$$

where,

D is maximum nose diameter;

A is boss tip diameter;

B is boss base diameter;

C is boss height.

4. A warhead nose in accordance with claim 3, wherein the boss is either cylindrical and/or tapered.

5. A warhead comprising:

the nose of claim 1;

a main section which includes an explosive charge; and an aft section which holds at least one penetration or initiation fuse.

6. A warhead comprising:

the nose of claim 1; and a main section which includes a payload.

7. A warhead nose comprising:

a body comprising a cylindrical section and a conical/ogive section, an outer surface with a top circumference and base circumference, and ribs partially extending from the outer surface of the cylindrical section and partially from the conical section, wherein the circumference around the ribs is larger than the base circumference and the top circumference, the warhead nose dimensions are determined by the following relations:

$$D \le E$$

$$\frac{1}{5}D \le F \le 2D$$

$$G \le \frac{1}{5}D$$

$$\frac{1}{20}D \le H \le \frac{1}{2}D$$

$$I \le \frac{2}{5}D$$

where,

D is maximum nose diameter;

E is external diameter of the ribs;

F is length of the ribs along the nose;

G is minimal width of the ribs

H is height of the rib protrusion; and

I is the minimal width of the rib at the adjoining point with the nose.

8. A warhead in accordance with claim 7, further comprising a boss the dimensions of which are determined by the following relations:

$$A \le \frac{1}{2}D$$

$$B \le \frac{1}{2}D$$

$$C \le \frac{1}{2}D$$

where,

D is maximum nose diameter;

A is boss tip diameter;

B is boss base diameter;

C is boss height.

* * * * *